US005369414A

United States Patent [19]

Yee et al.

[11] Patent Number: 5,369,414

[45] Date of Patent: * Nov. 29, 1994

[54] DUAL END RESONANT ARRAY ANTENNA FEED HAVING A SEPTUM

[75] Inventors: Hung Y. Yee; Phillip N. Richardson, both of Dallas, Tex.

[73] Assignee: Texas Instruments Incorporated, Dallas, Tex.

[ * ] Notice: The portion of the term of this patent subsequent to May 28, 2008 has been disclaimed.

[21] Appl. No.: 113,885

[22] Filed: Aug. 30, 1993

Related U.S. Application Data

[63] Continuation of Ser. No. 650,843, Feb. 5, 1991, abandoned, which is a continuation of Ser. No. 188,637, May 2, 1988, Pat. No. 5,019,831, which is a continuation of Ser. No. 736,009, May 20, 1985, abandoned.

[51] Int. Cl.[5] ..... H01Q 13/12

[52] U.S. Cl. ..... 343/771; 343/770

[58] Field of Search ..... 343/767-771

[56] References Cited

U.S. PATENT DOCUMENTS

| | | | |
|---|---|---|---|
| 2,981,948 | 4/1961 | Kurtz | 343/771 |
| 3,293,647 | 12/1966 | Crumpen | 343/771 X |
| 3,348,227 | 10/1967 | Rolfs | 343/771 X |
| 3,720,953 | 3/1973 | Ajioka | 343/771 |
| 4,340,892 | 7/1982 | Brunner et al. | 343/771 X |
| 4,819,003 | 4/1989 | Goto et al. | 343/771 |
| 5,019,831 | 5/1991 | Yee et al. | 343/770 X |

OTHER PUBLICATIONS

Takeshima, Tadaaki, "A Slot Array Antenna For Monopulse Tracking Radar"; *Microwave Journal*; Dec. 1966; pp. 63-65.

Watts, Jr., Chester B; "Simultaneous Radiation of Odd and Even Patterns by a Linear Array"; *Proceedings of the IRE*; Oct. 1952; pp. 1236-1239.

*Primary Examiner*—Benny T. Lee

*Attorney, Agent, or Firm*—Jacqueline J. Garner; Richard L. Donaldson; William E. Hiller

[57] ABSTRACT

An antenna 10 with a dual end resonant slot array feed 26 improves the bandwidth performance of a resonant slotted waveguide planar array antenna 10. The dual end resonant slot array feed 26 includes a tee junction 28/30 which may be either an E-plane 28 or H-plane 30, two waveguide sections 32, 34, and two E-plane waveguide bends 36, 38. The two waveguide sections 32, 34 are formed by a septum 40 mounted in a slotted waveguide 42 for separating the input tee junction 38, 30 from the slots 44 of the slotted waveguide. The ends of the septum 40 coacting with the ends of the waveguide to form the E-plane waveguide beds 36, 38 . Thus, resonant feeding of the series-slot waveguides 50 is achieved by the opposing traveling waves thereby eliminating the need to use resonant short circuits, cavities, or folded short circuits. Further direct coupling to the series slots 44 directly adjacent to the E- 28 or H-plane 30 feed point 50 is avoided by introducing the septum 40 between the feed point 50 and the row of slots 44.

6 Claims, 7 Drawing Sheets

DUAL END RESONANT ARRAY ANTENNA FEED HAVING A SEPTUM

This application is a continuation of application Ser. No. 07/650,843, filed Feb. 5, 1991 and now abandoned; which is a continuation of Ser. No. 07/188,637, filed May 2, 1988 now U.S. patent application Ser. No. 5,019,831, issued May 28, 1991; which is a continuation of Ser. No. 06/736,009, filed May 20, 1985 now abandoned.

BACKGROUND OF THE INVENTION

1. Field of the Invention

This invention relates to slotted array antennas and more particularly to a dual end resonant slot array feed for a resonant slotted waveguide planar array antenna.

2. Brief Description of the Prior Art

In the past slotted array antennae have been fed by single end feed mechanisms. When a waveguide section is fed at one end a waveguide short at the opposite end, sets up a standing wave in the waveguide. Shunt or series slot elements are located at appropriate points on the standing wave pattern (voltage or current peaks, respectively) to cause radiation with the correct amplitude and phase. Over a band of frequencies, the standing wave pattern in the waveguide varies relative to the location of the slots, causing errors in the slot amplitudes and phases. The magnitude of these errors increases in a direct relationship to the deviation of frequency from the design center frequency. The magnitude of the errors also increases with the length of the waveguide, and hence the number of slots. For waveguides having four or more slots, the usable bandwidth of a single end feed is on the order of $\pm 1$ percent.

To improve the bandwidth relative to a single end feed, E-plane and H-plane tee feeds have been used. The E-plane tee feed is in essence, two single end feeds joined at their respective feed points by an E-plane waveguide tee; improvement is caused by reducing the length (and number of slots) associated with each of the two single end feeds. The problem with the E-plane feed is that in order to maintain equal slot spacing one slot must lie directly under the E-plane tee. Owing to mutual coupling to the E-plane tee, this slot suffers a variation in phase and amplitude over the frequency band which differs significantly from the other slots in the array. This significantly different set of phase/amplitude errors for the slot under the E-plane feed largely offsets any bandwidth advantages that otherwise would have been obtained by using the E-plane tee.

By substituting an H-plane (shunt) tee for the E-plane (series) tee, the feed point for the slot waveguide can be located half way between two slots instead of directly over the slots. Nevertheless, as the H-plane feed must be about one-half wavelength wide (to avoid waveguide cutoff effects), the feed then couples to the two slots adjacent to the feed, yielding essentially the same bandwidth limitations as the E-plane feed.

For a large array antenna, the bandwidth typically has been limited to less than 2.5% using one of the above methods owing to the need to keep the manifold complexity within reasonable bounds. Both the amplitude and phase of the aperture illumination begin to be significantly degraded at $+1\%$ of the center frequency. The single end feed for a resonant waveguide array is described in a number of texts on antennas. Those persons skilled in the art desiring more detailed information pertaining to single end feeds are referred to Johnson and Jasik's "Antenna Engineering Handbook", Second Edition, 1984 and 1961, Chapter 9.

SUMMARY OF THE INVENTION

Accordingly, it is an object of this invention to provide a slotted array antenna having substantially increased frequency bandwidth.

Another object of the invention is to provide a feed for improving substantially the bandwidth performance of the slot array over that obtained using a single end feed. Yet another object of the invention is to improve substantially the amplitude and phase accuracy of the aperture illumination of the slot array antenna.

Briefly stated, the invention comprises a dual end resonant slot array feed applicable to either a series slot feed or a shunt slot feed. A resonant waveguide section that contains either shunt or series slots spaced apart by a one-half guide wavelength is fed or excited from both ends.

BRIEF DESCRIPTION OF THE DRAWINGS

Other objects and features of the invention will become more readily apparent from the following detailed description when read in conjunction with the accompanying drawings in which.

DESCRIPTION OF THE PREFERRED EMBODIMENT

Figure 1:
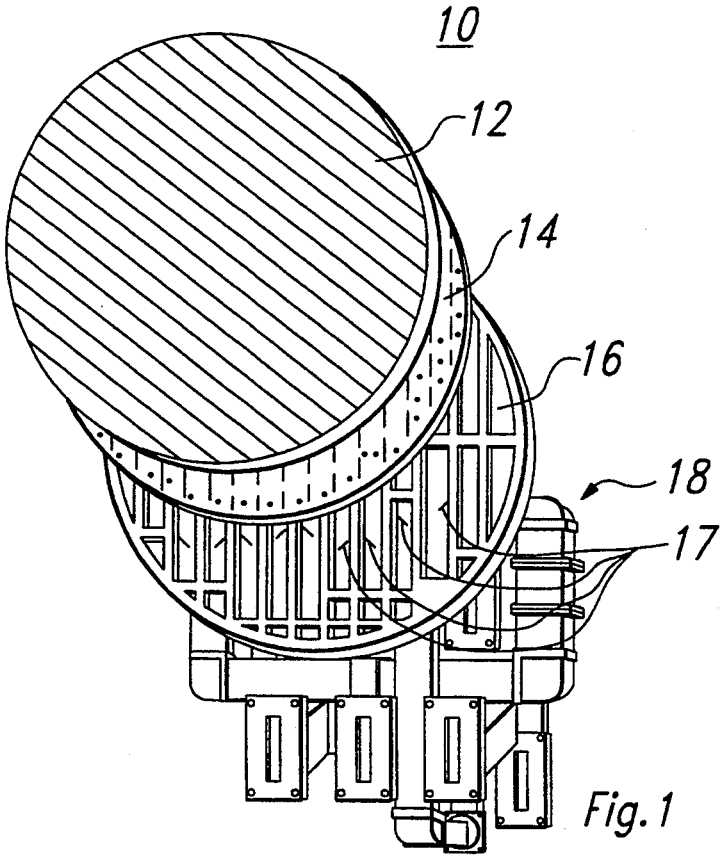
FIG. 1 is an exploded view of a slot antenna array.

Referring now to FIG. 1, a planar slotted array antenna 10 comprises a polarizer 12, a longitudinal shunt slotted plate 14, a rotational series slotted plate 16, and manifold 18. The series waveguide excites a row of series slots 17 which couple RF power into the shunt waveguides. (The series waveguides are not visable in this Figure, as they are located on the back side of 16.) The shunt waveguide excites the shunt slots, which are the radiating elements. All of the slots are spaced one half waveguide wavelength ($\lambda_g/2$) from the adjacent slots fed by the same guide.

Figure 2A:
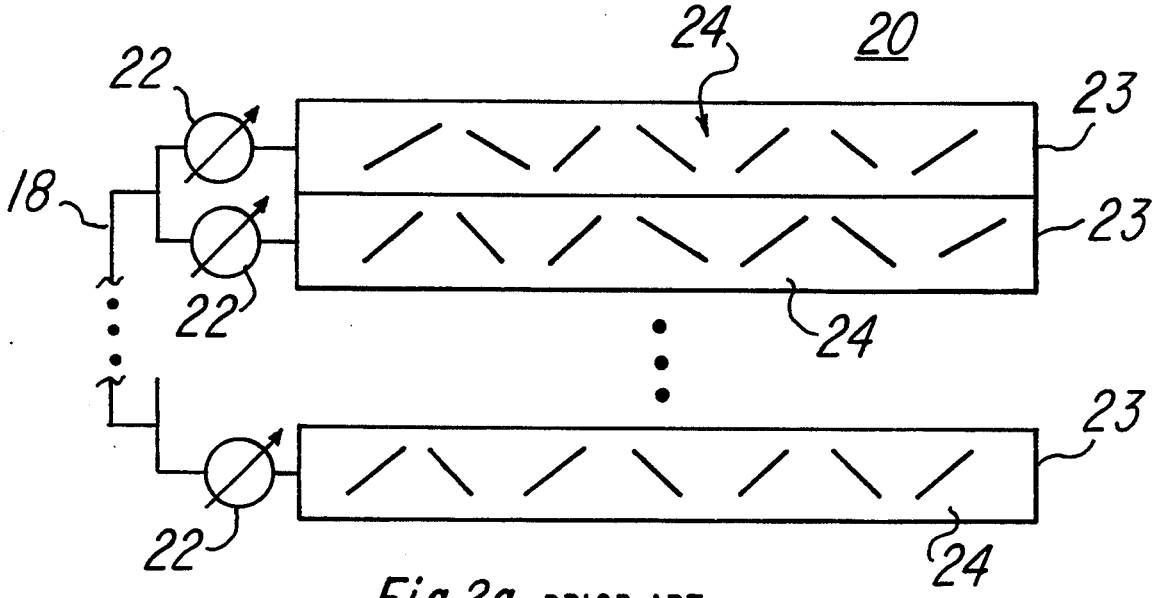
Fig. 2a PRIOR ART
FIGS. 2*a* and 2*b* are prior art realizations of slotted waveguide antennas.
Figure 2B:
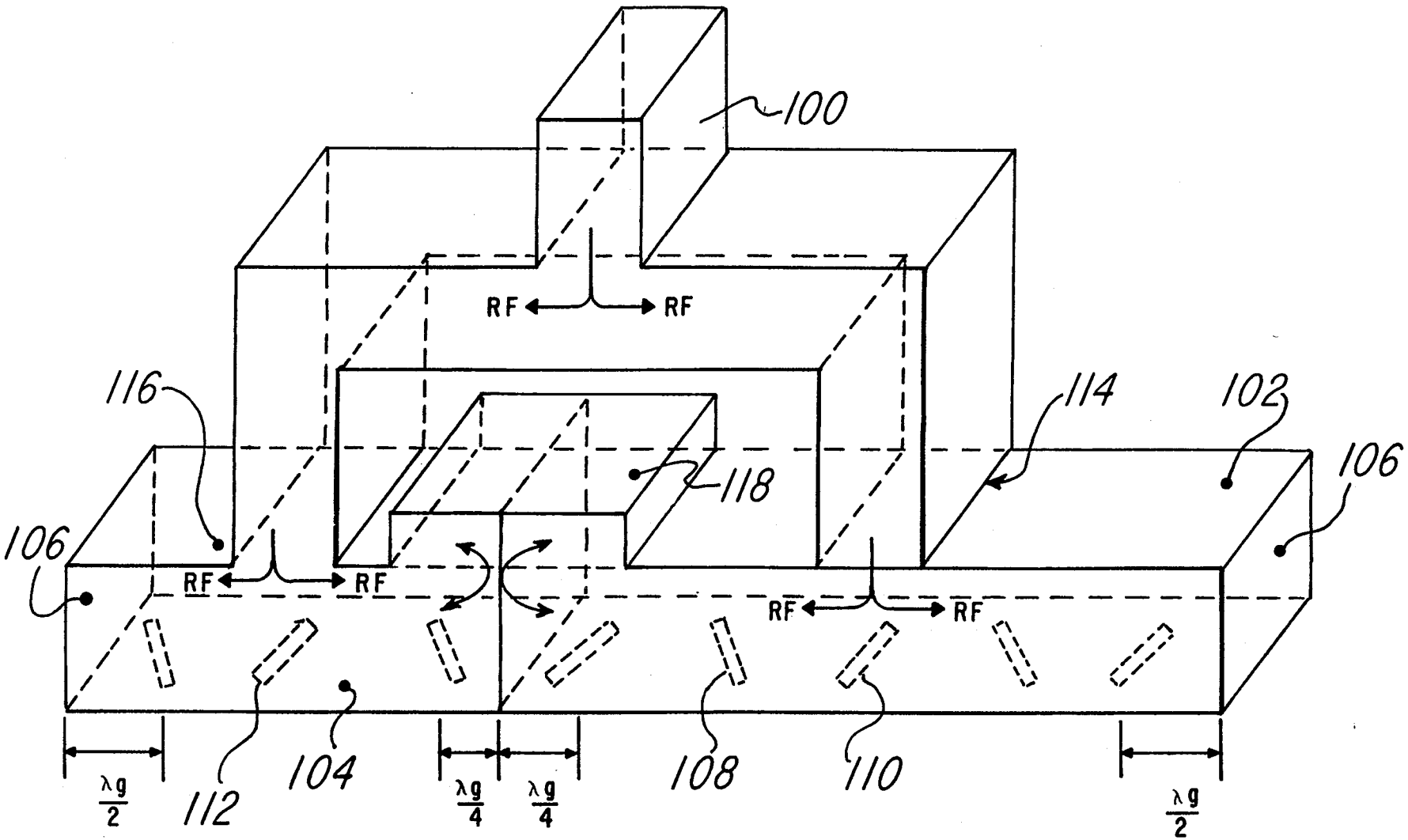
Fig. 2b PRIOR ART

One form of a prior-art waveguide feed system for the series slots is shown in FIG. 2*a*. Each of the series slot waveguides 24 is fed at one end by a feed manifold 18. A waveguide short-circuiting wall 23 at the opposite end of the waveguide sets up the standing wave needed for proper excitation of the series slots. In certain applications, variable phase shifters 22 may be added to electronically scan the antenna's radiation pattern, In another form of the prior art, the series slots are fed as shown in FIG. 2*b*. Here an E-plane waveguide tee 100 divides RF energy between two series slot waveguides 102 and 104, through E-plane tees 114 and 116. Waveguide shorts 106 at the outer ends of waveguides 102 and 104 set up the appropriate standing waves so that the series slots 108, 110, 112, etc., couple energy to the front face of the antenna. For a proper standing wave, the waveguide short 106 must be one-half wavelength from the end slot in the waveguide, as shown.

Similar $\lambda/2$ waveguide shorts are needed at the opposite ends of both waveguides 102 and 104, but only one-quarter wavelength $\lambda_g/4$ of space is available for each of these shorts (since a constant series slot spacing of $\lambda_g/2$ is imposed by the array grid). Therefore, prior art antennas have employed a folded waveguide short 118 in which a 180 degress E-plane bend is used to gain the needed spacing $\lambda_g/2$ between the shorting wall and the last slot. Such folded shorts are only an approximation to a true waveguide short circuit: they limit the array frequency bandwidth, and introduce numerous fabrication and assembly problems for the antenna.

Slots 110 and 112, being located directly under the E-plane tees 114 and 116, respectively, exhibit direct coupling effects to the tee, which results in phase and amplitude errors for these slots. These slots thus become another bandwidth limiting element in the antenna.

Figure 3A:
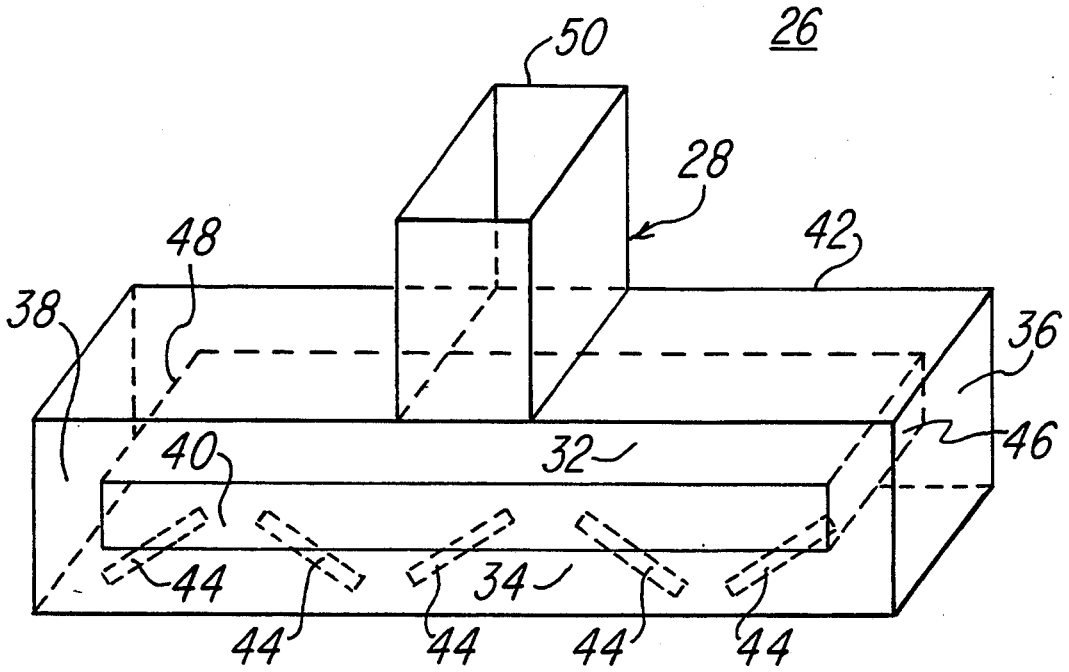
FIGS. 3*a* and 3*b* are views of dual end series slot feed using, respectively, E-plane tee feed and H-plane tee feed.
Figure 3B:
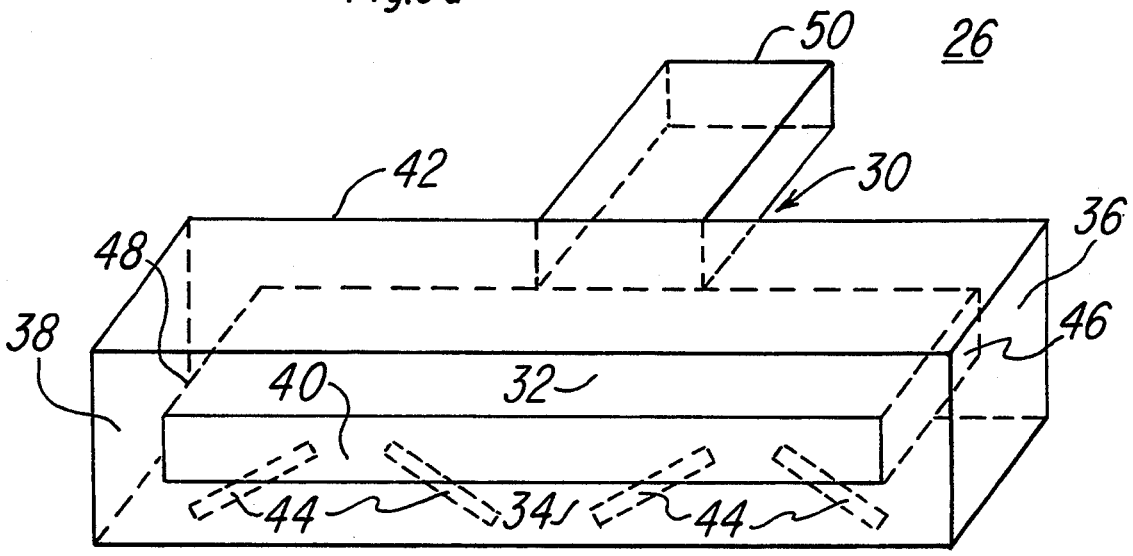

Referring now to FIGS. 3*a* and 3*b*, the dual end series slot feed 26 includes a tee junction which may be either an E-plane tee junction 28 (FIG. 3*a*) or an H-plane tee junction 30 (FIG. 3*b*), two waveguide sections 32 and 34, and two E-plane waveguide bends 36 and 38. The two waveguide sections 32 and 34 and the E-plane bends are formed by a septum 40. The septum 40 is placed across waveguide 42 to separate all (n) slots 44 from the tee junction. The two E-plane waveguide bends 36 and 38 are formed by the space between ends 46 and 48 of the septum 40 and the ends of the waveguide 42 which space interconnects the two waveguide sections 32 and 34. The thickness of the septum 40 is much less than the wavelength in order to minimize the antenna thickness. The total length of the waveguide loop is approximately equal to $n\lambda_g$. The series resistances of the slots 44 are selected to present an impedance that is matched to the input waveguide 50.

It will be appreciated from the foregoing description that a typical design of the dual end slot array feed is based on the following rules:

1. The H-plane or E-plane tee is separated from the slots by a septum. The E-plane tee (FIG. 3*a*) is located on the top of a series slot while the H-plane tee is located at the middle of two series slots (fig, 3*b*).

2. The sum of the normalized resonant slot resistances of all n series slots in one unit is equal to 2.

3. The waveguide loop length is approximately equal to n $\lambda_g$.

4. H-plane or E-plane tee junctions shall not be offset by more than $\pm 0.01\%$ $\lambda_g$.

Figure 5A:
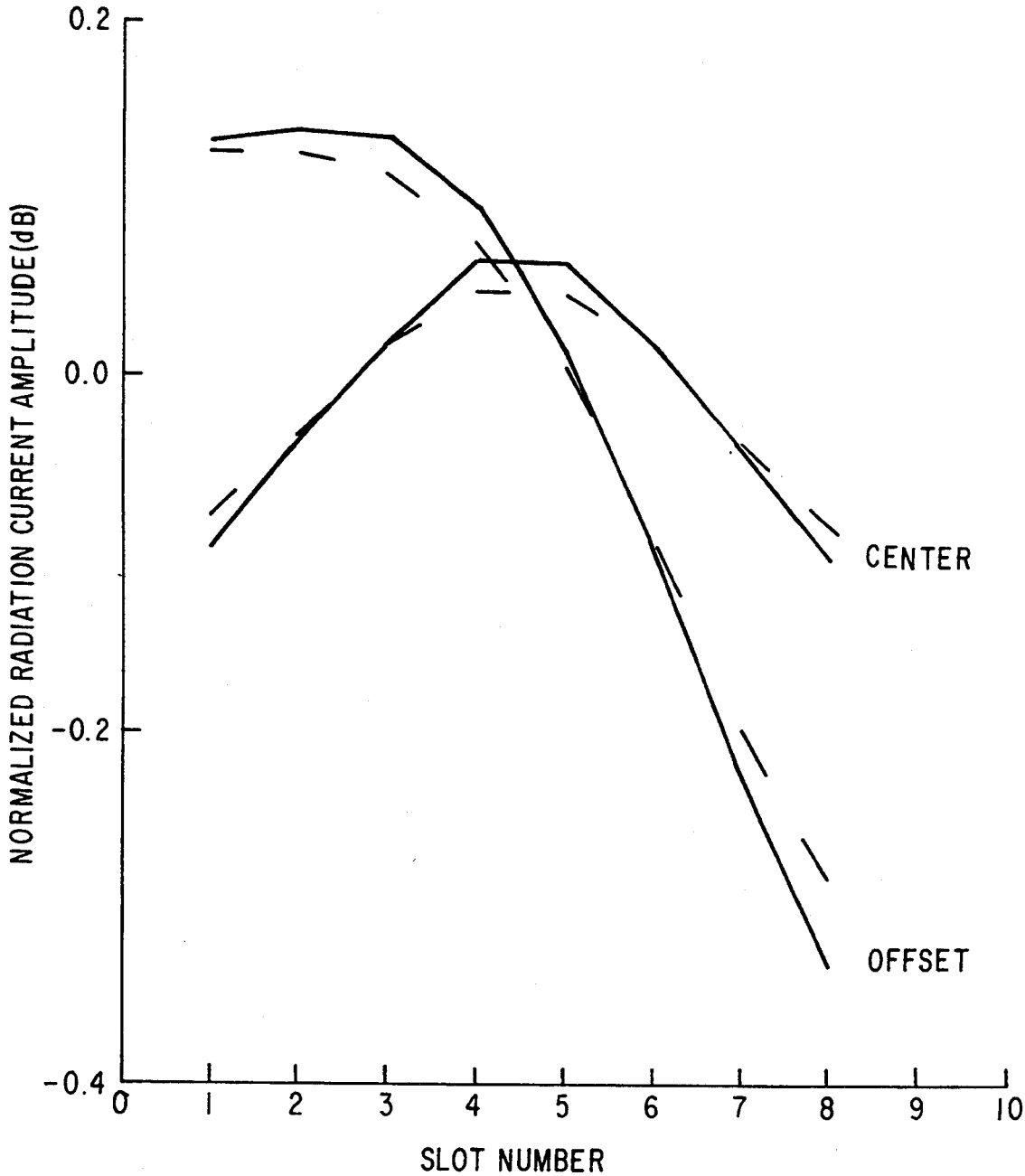
FIGS. 5*a* and 5*b* are charts, respectively, of the radiation current amplitude distribution for an 8 slot waveguide section using the invention, and of the radiation current phase distribution for an 8 slot waveguide section using the invention.
Figure 5B:
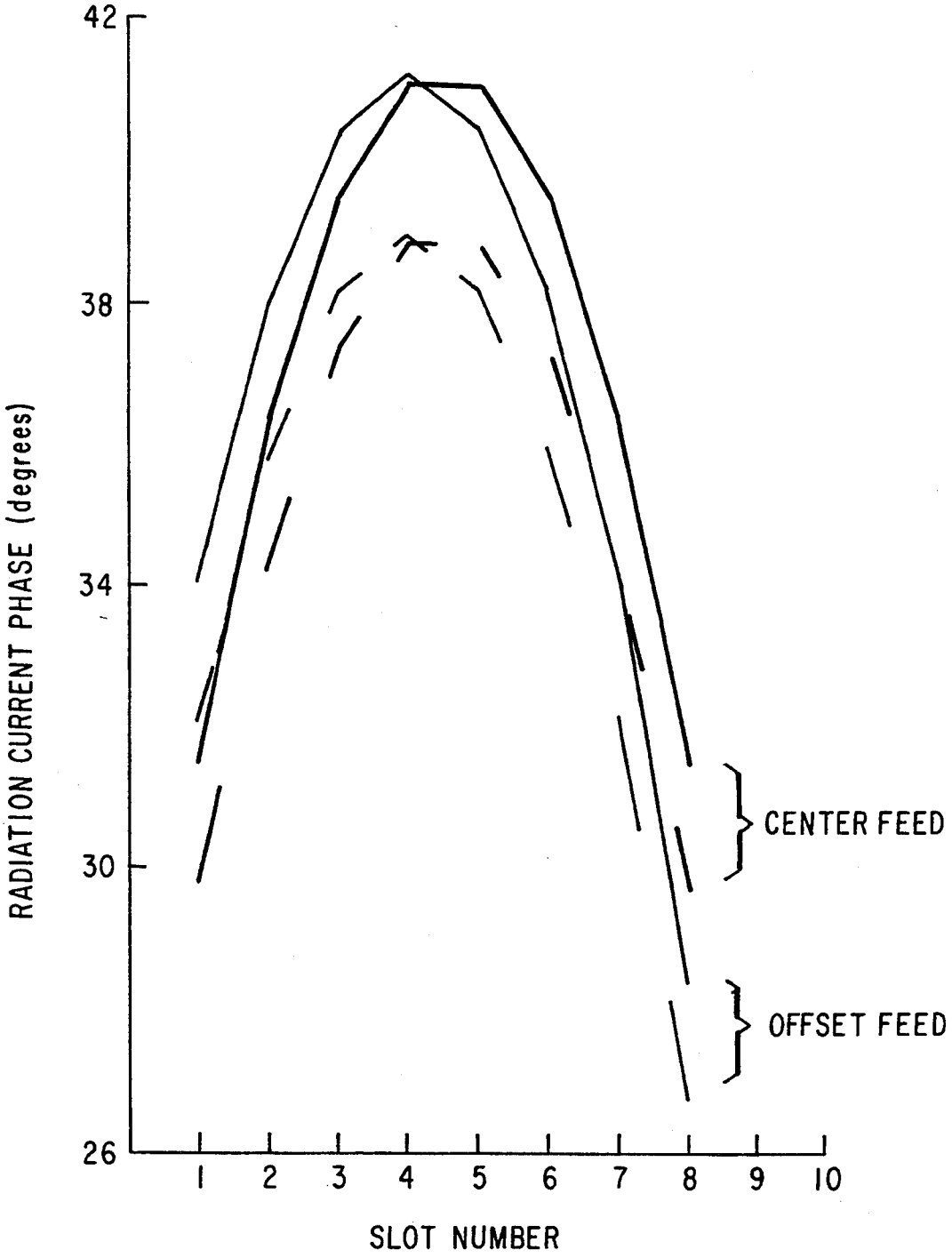

The improved performance of the dual end feed is demonstrated by theoretical analysis of a waveguide with 8 series slots using ideal H-plane tee junction and E-plane waveguide bends. The slots are identical and their normalized resistances are equal to 0.25. The radiation current amplitude and phase distribution compared to the ideal current is shown in FIGS. 5*a* and 5*b* respectively, and are computed for $\pm 1.8\%$ off the center frequency. The set of symmetrical curves are computed for the tree junction at the center while the unsymmetrical results are computed for the tee junction at a half guide wavelength off from the center. It is to be noted that the radiation current amplitude and phase variations are only 0.16 dB and 9.5 degrees, respectively, for the symmetrical feed over a 3.6% bandwidth. These variations in radiation current distribution increases to 0.44 dB and 13 degrees when the tee junction is offset by $\lambda_g/2$.

A comparison of the single end and dual end feed theoretical performances for the 8 slot array is shown in Table 1. These results are computed for 3.6% bandwidth. Obviously, the dual end feed provides an improvement in bandwidth performance as compared to the single end feed.

TABLE 1

Comparison of Single and Dual End Series Slot Feed, the Radiation Current Variations and Input VSWR for 8 Slot Section Within 3.6% Bandwidth.

| | SINGLE END FEED | DUAL END FEED | |
|---|---|---|---|
| | | CENTER | $\lambda_g/2$ OFF |
| AMPLITUDE (dB) | 2.5 | 0.16 | 0.47 |
| PHASE (degrees) | 27.2 | 9.5 | 12.8 |
| INPUT VSWR | 1.53 | 1.09 | 1.10 |

EXAMPLE

Figure 4A:
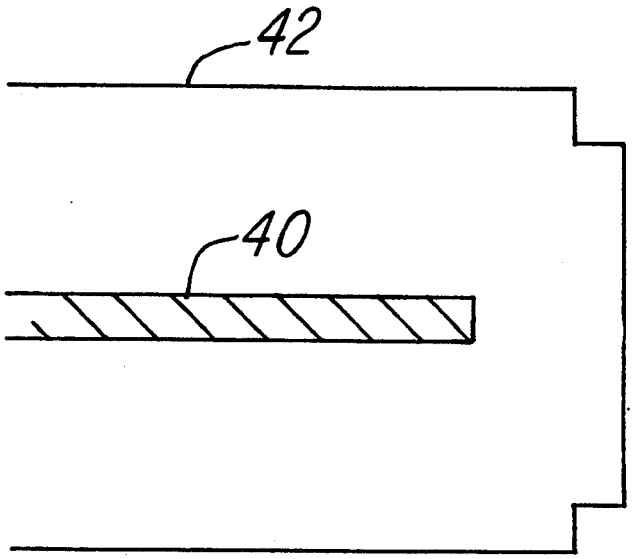
FIGS. 4*a* and 4*b* are, respective)y, a side view of the E-plane waveguide bend and a top view of the matched H-plane tee junction.
Figure 4B:
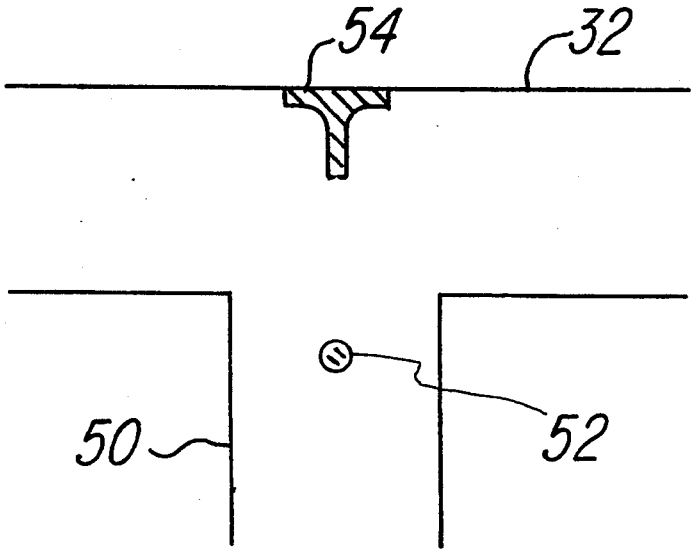

A dual end series slot feed was fabricated using the E-plane waveguide bend of FIG. 4*a* and the H-plane tee junction of FIG. 4*b*. A 16.5 GHz center frequency waveguide section with 5 unequal slots was employed. The dimensions of the waveguide 42 (FIG. 4*a*) were 0.496" by 0.155". For the E-plane waveguide bend, the thickness (t) of the septum 40 was 0.032", and the space "W" was 0.177". For the H-plane tee junction (FIG. 4*b*) the input 50 was 0.496" wide, with a tuning stub 52 which is 0.025" high and a 0.138" diameter positioned 0.637" from the end of waveguide section 32. Waveguide section 32 has a width of 0.496" and a T shaped matching vane 54 centered with respect to the input 50. The T has a length of 0.222" and a thickness of 0.030". Tests showed that the VSWR of the E-plane waveguide bends is less than 1.10 over a 6% bandwidth, and the input VSWR of the H-plane tee junction is less than 1.18 over the same bandwidth.

Figure 6A:
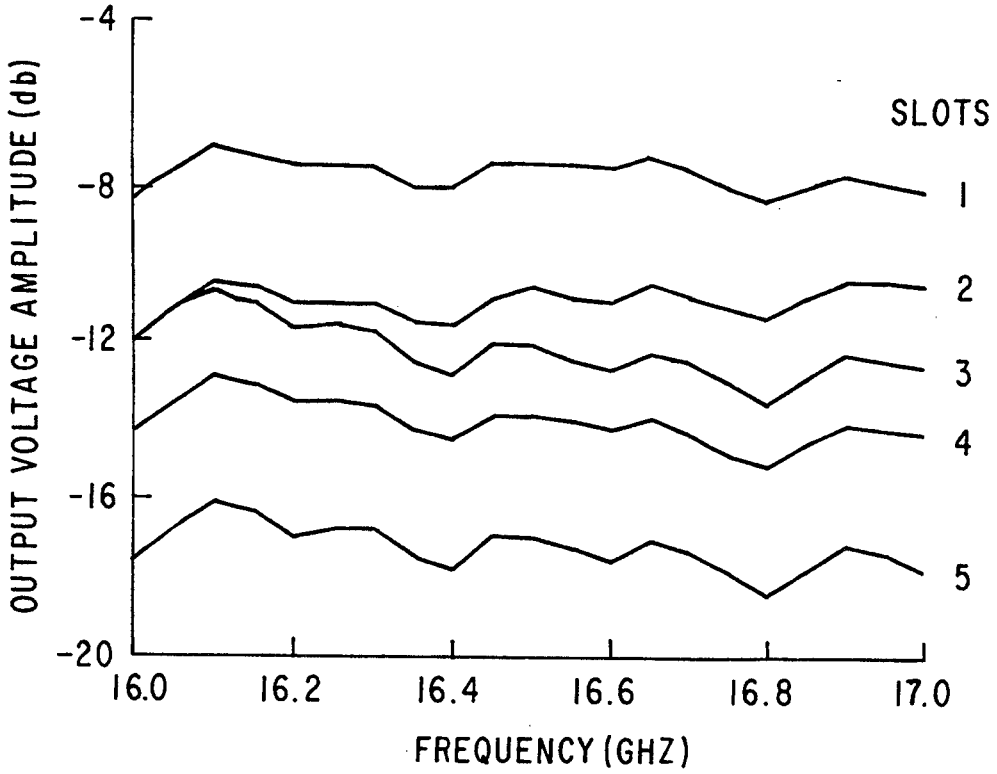
FIGS. 6*a* and 6*b* are charts, respectively, of measured slot output voltage amplitude and slot output voltage phase (degrees) compared to slot 3 of a 5 slot array.
Figure 6B:
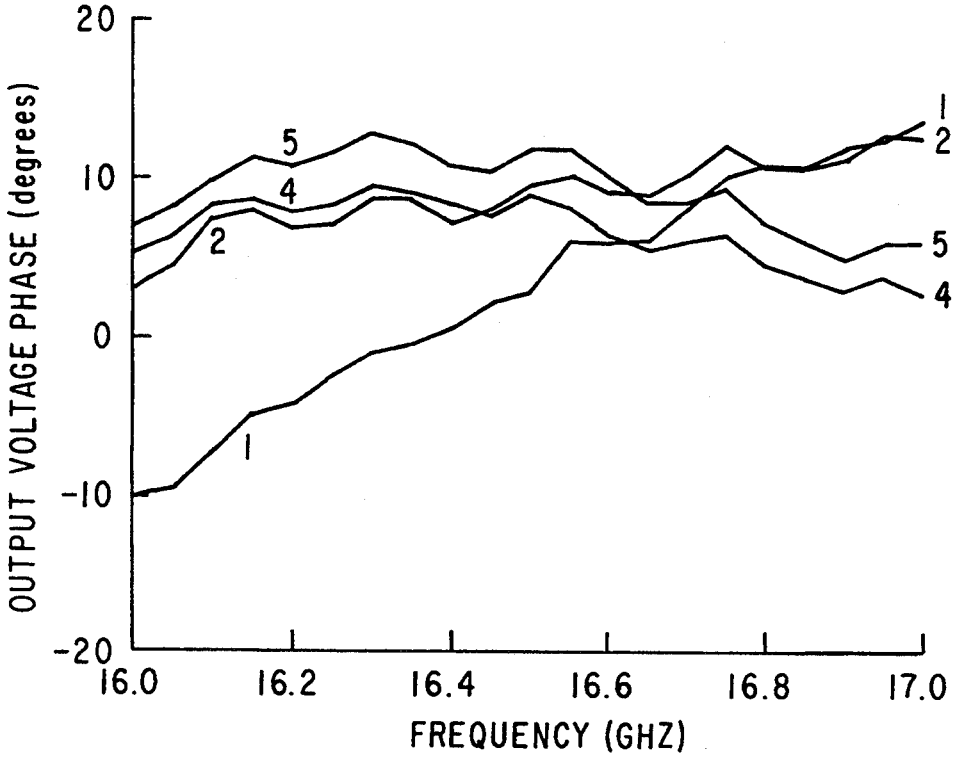

The measured output voltage amplitude and phase from the slots are shown in FIGS. 6*a* and 6*b*. The slot output voltages are measured from a set of identical waveguides in which the RF power is coupled through the series slots.

It will be noted from FIG. 6*a* that the measured voltage amplitudes are consistently evenly distributed over a wide bandwidth. The length of slot 2 is slightly too short (owing to fabrication errors) such that the amplitude falls off at the low frequency. The phase plot (FIG. 6*b*) was obtained by normalizing to the phase of slot 3, i.e., the phase of slot 3=0. All the phases track very well except the first slot. However, the largest discrepancy (at 16.0 GHz) over a 6% bandwidth is only 17 degrees.

Although only a single embodiment of the invention has been described, it will be apparent to a person skilled in the art that various modifications to the details of construction shown and described may be made without departing from the scope of this invention. For example, while most of the descriptions have addressed the feeding of series slot elements in the broad wall of a rectangular waveguide, the method is equally applicable to both shunt and series slots in waveguides of arbitray cross-section.

Also, it will be understood by those skilled in the art that this antenna will operate reciprocally, having the same characteristics whether transmitting or receiving, despite the fact that the antenna has been described above primarily as a transmitting antenna.

What is claimed is:

1. An antenna for at least one of transmitting and receiving rf energy comprising:

a resonant waveguide having spaced-apart first and second sections therein; said first section having a first side and said second section having a second side, said first and second sections each having opposing ends, a septum positioned generally parallel to said first and second sides to divide said resonant waveguide into said first and second sections, waveguide feed means coupled to said second section, said second section simultaneously coupling substantially equal portions of rf energy of a substantially predetermined frequency from said feed means to opposing ends of said second section, a plurality of substantially equally spaced slots disposed on said first side of said first section, and waveguide bends, providing in conjunction with said septum which divides said first and second sections, a loop having a length substantially equal to $n\lambda_g$, where n is equal to the number of slots and $\lambda_g$ is the wavelength inside said waveguide with reference to the rf energy, coupling said equal portions of rf energy from opposing ends of said second section into corresponding opposing ends of said first section to provide, by the interaction of said equal portions of rf energy with each other, a standing wave in said first section for exciting said slots.

2. An antenna according to claim 1, wherein said wavegide feed means includes a tee junction coupled to said second section.

3. An antenna according to claim 2 wherein said tee junction is an E-plane tee junction coupled to said second side.

4. An antenna according to claim 2 wherein said second section includes a sidewall, said tee junction being an H-plane tee junction coupled to said sidewall.

5. An antenna according to claim 1 wherein said slots are series slots.

6. An antenna according to claim 1 wherein said slots are shunt slots.

* * * * *